US006312216B1

(12) United States Patent
Falcimaigne

(10) Patent No.: US 6,312,216 B1
(45) Date of Patent: Nov. 6, 2001

(54) MULTIPHASE TURBO MACHINE FOR IMPROVED PHASE MIXING AND ASSOCIATED METHOD

(75) Inventor: Jean Falcimaigne, Bois Colombes (FR)

(73) Assignee: Institut Francais Du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 09/386,477

(22) Filed: Aug. 31, 1999

(30) Foreign Application Priority Data

Sep. 2, 1998 (FR) ..... 98 10997

(51) Int. Cl.[7] ..... F04D 1/04

(52) U.S. Cl. ..... 415/74; 415/211.2; 415/221; 416/223 R; 416/236 R

(58) Field of Search ..... 415/73, 74, 75, 415/1, 116, 117, 208.1, 211.2, 220, 221, 199.1, 199.6; 416/175, 176, 177, 183, 196 A, 196 R, 203, 223 A, 223 R, 236 R, 243

(56) References Cited

U.S. PATENT DOCUMENTS

| | | | | |
|---|---|---|---|---|
| 2,920,864 | * | 1/1960 | Lee | 416/62 |
| 4,778,341 | * | 10/1988 | Corradini et al. | 416/181 |
| 4,826,398 | * | 5/1989 | Gillichsen | 415/143 |
| 4,904,158 | * | 2/1990 | Kun | 416/183 |
| 5,628,616 | * | 5/1997 | Lee | 415/58.2 |

FOREIGN PATENT DOCUMENTS

| | | | |
|---|---|---|---|
| 329147 | | 4/1958 | (CH) . |
| 0 468 877 | | 1/1992 | (EP) . |
| 0 671 563 | | 9/1995 | (EP) . |
| 0 780 577 | | 6/1997 | (EP) . |
| 2 157 437 | | 6/1973 | (FR) . |
| 1521754 | * | 8/1978 | (GB) . |
| 2 066 898 | | 7/1981 | (GB) . |
| 5-248395 | * | 9/1993 | (JP) ..... 416/203 |

* cited by examiner

*Primary Examiner*—Edward K. Look
*Assistant Examiner*—Ninh Nguyen
(74) *Attorney, Agent, or Firm*—Antonelli, Terry, Stout & Kraus, LLP

(57) ABSTRACT

The invention is a device and method which varies the pressure of a multiphase fluid comprising at least one liquid phase and at least one gaseous phase. The device comprises a housing, a hub, a rotating shaft, and at least two blades defining at least one flow channel. At least one turbulence producing structure is disposed inside at least one flow channel which generates a turbulent zone inside the the at least one channel which mixes the liquid and gaseous phases of the multiphase fluid.

42 Claims, 5 Drawing Sheets

PRIOR ART

MULTIPHASE TURBO MACHINE FOR IMPROVED PHASE MIXING AND ASSOCIATED METHOD

BACKGROUND OF THE INVENTION

1. Field of the Invention

The present invention pertains to turbo machines which supply or recover the energy of a multiphase fluid, and to vary the pressure thereof.

2. Description of the Prior Art

The pumping, and also the expansion of a multiphase fluid constituted by at least one liquid phase and a gaseous phase, poses a problem which is difficult to resolve.

For example, in the case of the compression of a multiphase fluid, experience shows that the performance of the classic centrifugal pumps slumps as soon as the level of gas exceeds a few percent.

The best adapted classic rotodynamic pumps do not allow gas levels of 20 to 25% to be exceeded without the rise in pressure falling considerably. The other types of pumps, such as the reciprocating displacement pumps or screw pumps, jet-effect pumps, are also limited in their uses and their energy efficiency.

Various pumping devices have been developed in the prior art in an attempt to improve the performance of the pumps working with multiphase flow.

For example, French Patents 2,333,139, 2,471,051 and 2,665,224 disclose hydraulic cells for axial or quasi-axial pumps which exhibit blading and inter-blade channel geometries for the pumping of multiphase fluids. These cells ensure both limitation of the accelerations and good homogenisation of the fluid which are essential elements for obtaining good performance with diphase flow. The pumps are composed of one or more cells of this type, mounted in successive stages on the rotating shaft.

French Patent 2,743,113 describes a device comprising blading disposed in tandem to ensure the passage of the liquid phase from the front side to the back side and to improve the mixing of the liquid and gaseous phases in the flow channels.

German Patent 2,287,288 is an example of a stator for an axial multiphase pump designed to alternate the direction of rotation of the multiphase flow between the outlet of the rotor and the inlet of the stator. Such an arrangement makes it possible to improve the mixing of the liquid and gaseous phases.

U.S. Pat. No. 5,628,616 describes impellers for a semi-radial or "mixed flow" type pump comprising openings which allow the recirculation of the gaseous and liquid phases in order to ensure their mixing.

The communication entitled "Innovative Solutions for Multiphase Pumping", presented in June 1995 at the "Multiphase 95" $7^{th}$ international conference discloses a counter-rotating compressor for wet gas comprising impellers turning in the opposite direction around the same axis so as to improve the mixing of the gaseous and liquid phases.

The rise in pressure in multiphase flow obtained through such devices reaches by way of example 30 to 80% of the rise in pressure which would be obtained with a monophase fluid with a density equal to the mean density of the mixture.

Obtaining good performance with a multiphase pump comes in large part from its capacity for intimately mixing the liquid and gaseous phases. However, in the current state of the art, the multiphase flow in the cells remains practically parallel with the surfaces of the blading, the housing and the hub of the hydraulic cells.

SUMMARY OF THE INVENTION

The present invention concerns a device and a method designed to improve the increase in the gains in pressure or reductions in pressure to which a multiphase fluid is subjected. The device is equipped with one or more mechanical device which improves mixing of the liquid and gaseous phases subject to the variation in pressure.

The present invention applies to all the types of rotodynamic multiphase pumps and more generally to all the multiphase hydraulic turbo machines, for example the compressors for wet gas or the multiphase turbines.

The invention improves the mixing of the different liquid and gaseous phases subjected to variation in pressure.

The invention is applied notably, but not exclusively, in the field of pumping of a multiphase fluid, for example, a diphase petroleum effluent composed of a mixture of oil and of gas and can also be applied in devices for expansion of multiphase fluids, allowing recovering of mechanical work.

The present invention concerns a device which varies the pressure of a multiphase fluid comprising at least one liquid phase and at least one gaseous phase, the device comprising at least a housing, a hub, a rotating shaft, at least one means which varies the pressure of the fluid (impeller, diffuser), at least one of said means having at least two blades (6*i*, 6*i*+1) defining a flow channel for the multiphase fluid.

The invention comprises at least one device disposed inside at least one flow channel the at least one device generating turbulent zone inside the flow channels which mixes the liquid and gaseous phases of the multiphase fluid.

The at least one device generates a single, double or even multiple helical flows inside the at least one flow channel.

The helix or helices may exhibit an angle α such that the intensity of the flow satisfies a dimensionless ratio S or "swirl number"

$$S = \frac{\int\int u_1(xu_y - yu_x)dxdy}{r_{\max}\int\int u_1^2 dxdy}$$

in which $u_i$ is the longitudinal component of the velocity, $u_x$ and $u_y$ are its transverse components $u_t$ (in the plane of rotation), $r_{max}$ is the greatest value of $r=\sqrt{x^2+y^2}$ with a value for S lying between 0.3 and 0.8 and preferably between 0.5 and 0.75; S characterising the intensity of rotation of the flow, and more precisely being defined as the ratio of the flux of the kinetic moment of rotation to the flux of the longitudinal momentum.

The at least one device can be one or more "beads" having a helical shape and being disposed in a helix on the walls of at least one of the blades and the hub.

The beads are disposed for example inside at least one flow channel of at least one impeller and/or diffuser.

The height of a bead is for example between ⅕ and 1/10 of the width of the flow channel or channels, the width of the flow channel or channels being defined for example by the minimum distance between two successive blades.

The device designed to impart energy to a multiphase fluid can be formed by at least one one groove in a helix formed in one of the walls at least forming a flow channel and over at least a portion of the length of the channel.

The groove or grooves have a depth for example of between 1/20 and 1/10 of the thickness of one of the blades forming the flow channel.

The helix is for example of variable pitch. The pitch of the helix diminishes for example in the main direction of flow of the multiphase fluid.

The groove or grooves are positioned for example in at least one impeller and/or at least one rectifier.

The device which imparts energy to a multiphase fluid comprises for example at least one of the following elements: a twisted strip, an auxiliary blade, the elements being disposed in at least one of the flow channels.

The twisted strip is disposed in the proximity of the inlet of one or more flow channels.

The present invention also concerns a method for improving the transfer of energy achieved in a device which varies the pressure of a multiphase fluid comprising at least one gaseous phase and one liquid phase, the device comprising at least one flow channel. With the method according to the invention is characterised in the fluid is passed into at least one flow channel formed by at least two devices making it possible to vary the pressure such as blades, a hub and a housing, the channel being equipped with mechanical device making it possible to generate a turbulent zone in order to increase the mixing of the liquid and gaseous phases.

At least one helical rotation can be imparted to the flow inside the channel so as to increase the mixing of the liquid and gaseous phases.

The flow is for example a single helical flow such that the ratio S of the intensity of flow calculated in at least one transverse section of the channel lies between 0.3 and 0.8 and preferably between 0.6 and 0.75.

The helical flow is for example in the opposite direction to the direction of rotation of the moving parts of the device.

For example, at least two helices are generated inside a same channel, the two helices having an opposite direction of rotation, the direction of rotation being from the housing towards the center of the flow channel.

The pitch of the helix generated by the helical movement can be varied so as to reduce the pitch progressively to transform the kinetic energy of translation of the liquid phase or liquid phases into rotational energy and thus reduce the longitudinal flow velocity thereof.

The device and the method according to the invention advantageously for pump a multiphase fluid such as a petroleum effluent.

The device and the method according to the present invention improves the performance of machines which impress or expand of a multiphase fluid to that obtained with the aid of monophase machines.

In the case of a multiphase pumping device, the helical movement which a fluid can adopt makes it possible to increase the rise in pressure provided by each compression cell and improve overall performance. In the case of an application to a turbine, an increase in the mechanical power supplied at constant expansion is achieved.

BRIEF DESCRIPTION OF THE DRAWINGS

Further advantages and features of the device according to the invention will be better understood on reading the description which follows of a non-limiting example with reference to the attached figures in which.

DESCRIPTION OF THE PREFERRED EMBODIMENTS

So as to ensure a better understanding of the device and the method according to the invention, the description which follows, given by way of illustration and in no way limiting, concerns a device adapted for compressing of a multiphase fluid.

The invention promotes the interaction between the phases by creating more complex flows than those existing in the prior art inside at least one channel of the compression device. The flow can be a simple turbulent zone or preferably a more organized structure.

Such types of flow make it possible notably to increase the length of the mean path of the particles of fluids and thus the interaction between the liquid and gaseous phases mentioned previously.

The mechanical work supplied by the impellers of a pump is converted into energy in the fluid, more precisely into enthalpy, proportionally to the mass flow of the phases, and thus is essentially transmitted to the densest phase or phases. In the absence of interactions between the phases or if the interactions are weak, the increase in pressure which must remain identical between all the phases is mainly determined by the gaseous phase. The excess enthalpy of the dense phases essentially produces an acceleration of this phase, with a correlative acceleration of the gaseous phase. To obtain acceptable performance from a multiphase pump, it is essential that a transfer of energy and momentum takes place between the liquids and the gas.

Promoting the mixing of the phases facilitates the transfer of the momentum from the liquid phase to the gaseous phase, and thus the transfer of energy imparted to the multiphase fluid or the compression of the latter (or compression ratio).

The movement generated in at least one channel can notably be a flow in the form of a helix, the helix being more or less complex.

Figure 1:
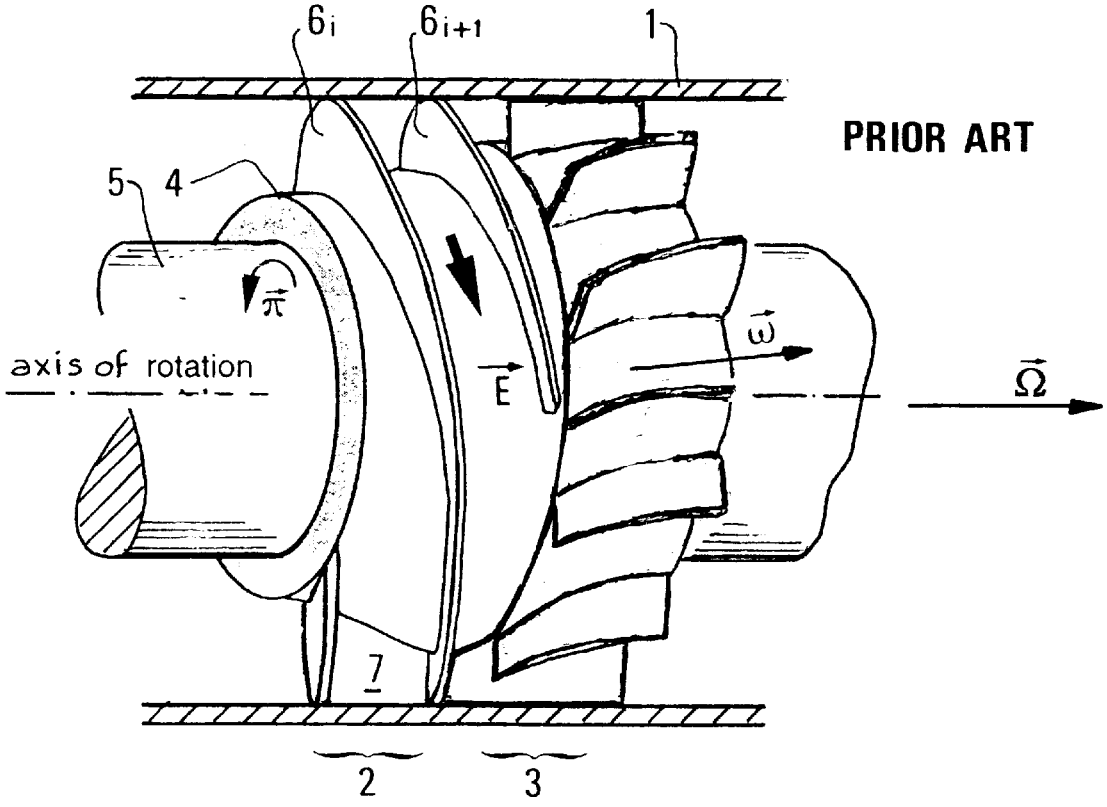
FIG. 1 shows a perspective view of a compression cell according to the prior art.

FIG. 1 shows, viewed in perspective, a non-limiting example of an element or cell of a multiphase pump according to the prior art comprising an impeller and a rectifier or diffuser disposed in a housing 1.

The impeller 2 is locked to a hub 4 itself locked to the rotating shaft 5 which is entrained in rotation in the direction indicated by the arrow $\vec{\pi}$ while the device is operation.

The rectifier 3 is locked to the housing 1 by means normally used in the art.

The impeller comprises a plurality of blades 6*i*. Two consecutive blades 6*i;* 6*i*+1, the housing 1 and the hub 4 which define a circulation channel 7 or flow channel for the multiphase fluid in flow.

The arrow $\vec{E}$ gives the direction of flow of the multiphase fluid inside a channel.

The geometric characteristics of the blades and/or the circulation channels for the fluid can exhibit geometric and dimensional characteristics such as those described in one of the previously mentioned three French Patents and one British Patent, respectively of.

The Assignee, 2,333,239, 2,471,051 and 2,665,224 and 2,287,288.

Figure 2:
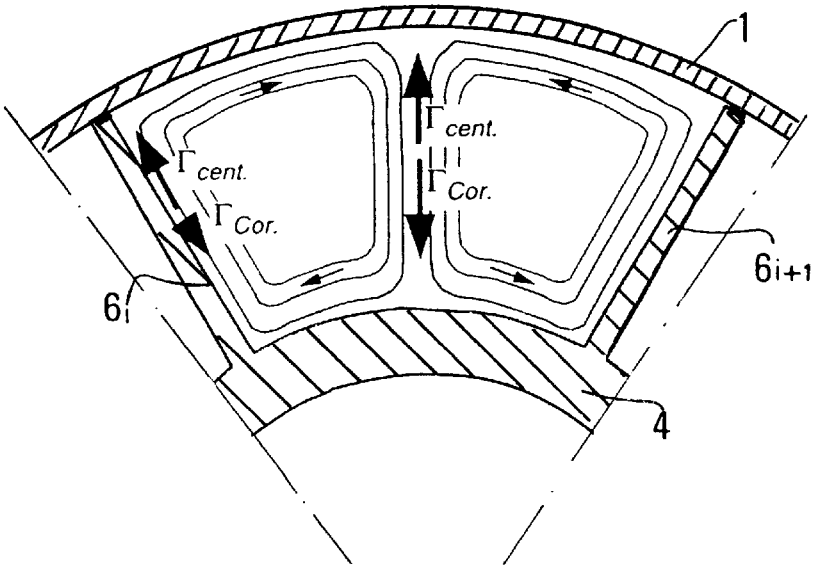
PRIOR ART FIG.2
FIGS. 2 and 4 show the behavior of the fluid flowing in the hydraulic cells according to the prior art.

FIG. 2 shows a diagram of the secondary flow of the fluids in a straight section of the channels, which can occur naturally due to the rotation of the impeller 2.

In the axial or quasi-axial pumps the preponderant component of the flow velocity of the multiphase fluid is parallel to the axis of rotation. In the turning parts of these pumps, the relative acceleration of the fluid circulating in the channels and the centrifugal acceleration produced by the rotation are roughly balanced by the complementary Coriolis acceleration given by the vector product $2\vec{\Omega}\cdot\vec{\omega}$, with $\vec{\omega}$ shown in FIG. 1 being the rotational vector of the rotor and $\vec{\omega}$ shown in FIG. 1 being the relative speed of the fluid particles in relation to the impeller. This complementary acceleration is directed towards the axis of the pump when considering usual orientations of $\vec{\Omega}$ and $\vec{\omega}$ leading to the increase in the energy in the fluid.

The exact balance between the different radial acceleration components is only obtained at a particular speed $\vec{\omega}$ which is a function of the angle of the vectors $\vec{\Omega}$ and $\vec{\omega}$, i.e. the mean local angle of the channel in relation to the axis of the pump. As the speed producing the balance is not necessarily the same over the entire length of the channel, the values of the angles of the blades can be selected within the ranges of values given in the patents mentioned previously in order to limit the amplitude of the accelerations.

In the vicinity of the wall of the blades, the speed $\vec{\omega}$ of the fluid is reduced in the thickness of the boundary layer. The complementary Coriolis acceleration is reduced and the resultant acceleration is directed towards the housing of the pump, introducing a hydrodynamic imbalance in the transverse plane in the flow channels. This complementary phenomenon ensures a limited natural mixing of the flow.

The degree of rotation thus generated, shown in FIG. 2, helps to homogenise the multiphase fluid, the imbalance of the accelerations remaining confined in a relatively thin thickness of the boundary layer.

For example, with the hydraulic diameter Dh of the impeller channels produced according to the teaching of the patents mentioned previously, which lies between 20 and 35 mm, the mean relative speed of the fluid in relation to the walls of the channels in the usual conditions of use of these pumps reaches levels of at least 50 to 70 m/s. The kinematic viscosity of the pumped liquids lies for example between 1 and 100 cStockes. In such conditions the thickness of displacement, using the theory of the boundary layer, which corresponds to the zone in which the fluid is slowed by the presence of the wall and which is of the order of a few tenths of a micron to about one millimetre.

One of the means used to increase the transfer of the momentum from the liquid phases to the gaseous phase according to the invention increases the volume of fluid set in rotation inside the channels.

For example, it is possible to impart a rotation about the main direction of flow artificially so that the fluid trajectories form a helix in a reference linked to the rotor. Different variants are given in FIGS. 3A, 3B and the devices to achieve them in FIGS. 5 to 8.

Figure 3A:
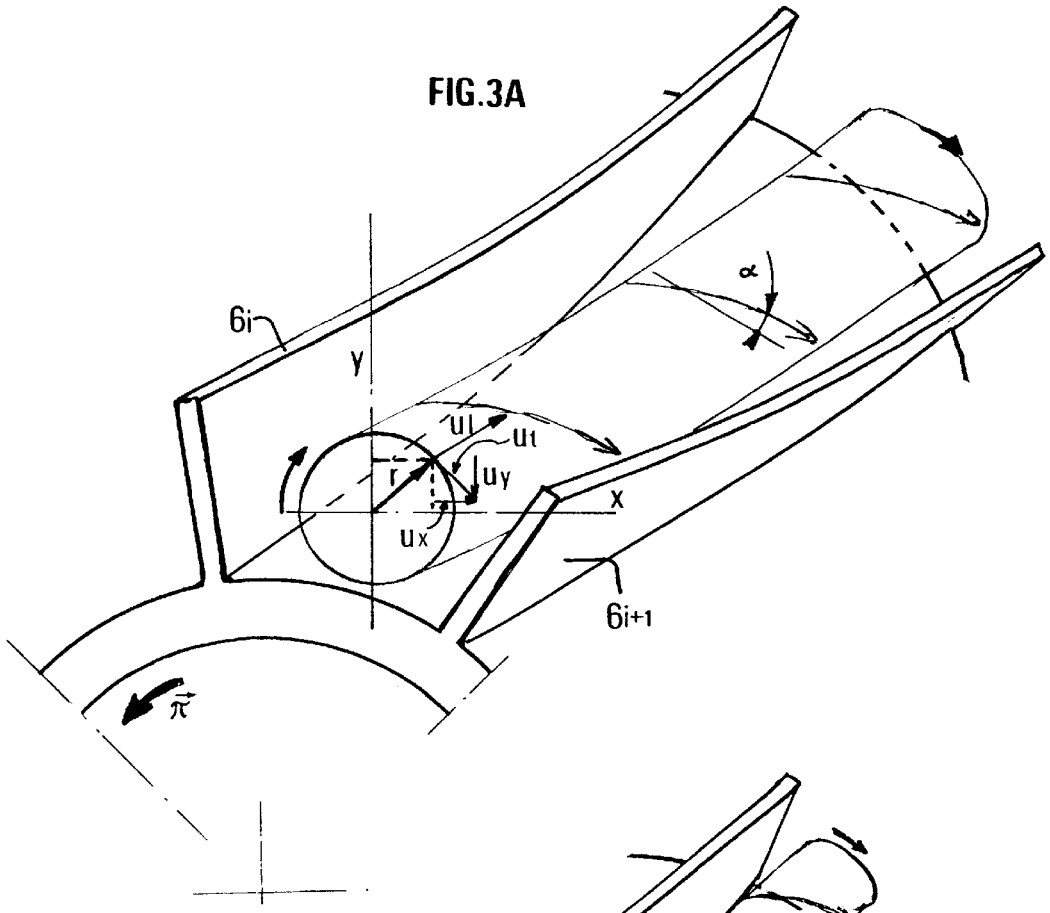
FIGS. 3A and 3B show to variants of movement imparted to the multiphase fluid in flow, and FIGS. 5, 5*a,* 6, 7 and 8 show different structures for improving the mixing of the gaseous and liquid phases.
Figure 3B:
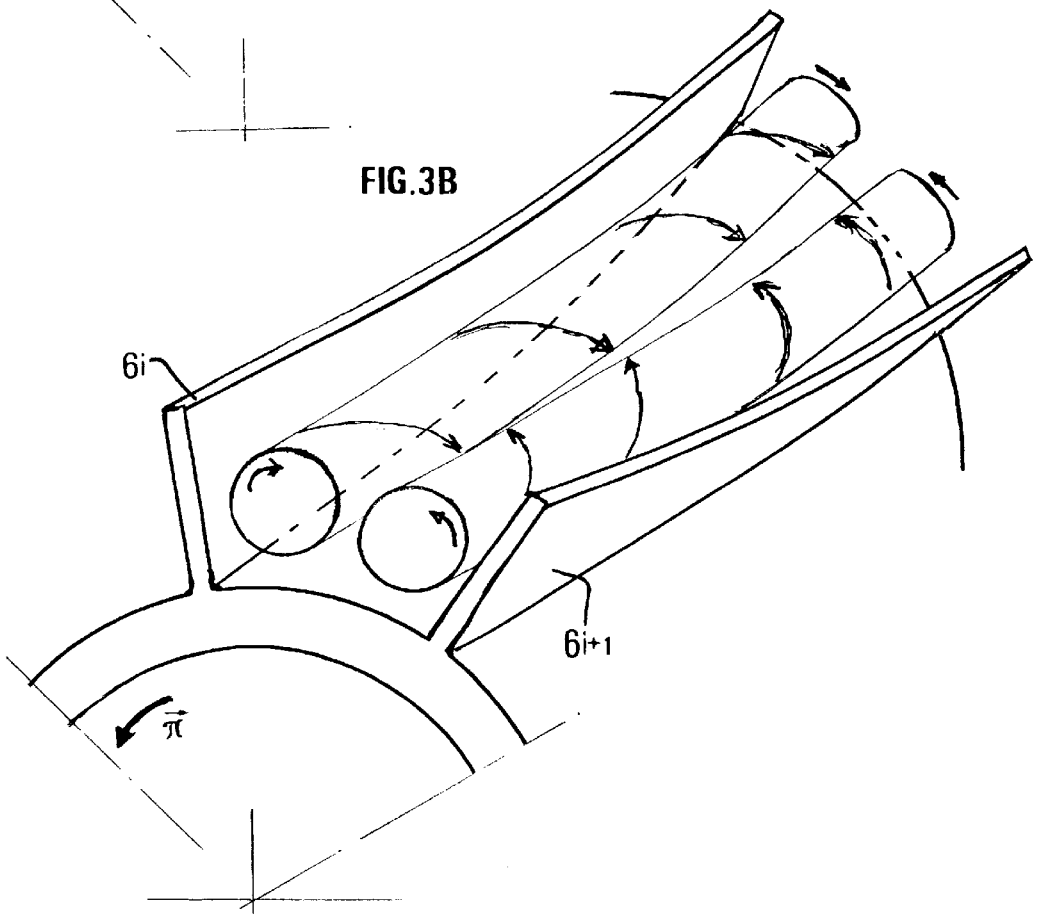

FIGS. 3A and 3B show respectively the single helix or double helix movement or movements obtained for example using the mechanical devices mentioned previously in at least one flow channel, some examples of which are described in FIGS. 5 to 8. The arrangement and the choice of these devices will depend on the mixing of the fluid to be produced to obtain better homogeneity of the gaseous and liquid phases, and on the physical nature of the multiphase fluid being pumped.

The single or double helix is obtained artificially by causing rotation about the main direction of flow with the aid of the mechanical devices described below.

FIG. 3A shows an example of a single helix for which the direction of flow of the fluid goes in an opposite direction to the direction of rotation of the impeller. The expression "single helix" corresponds to a helical movement which takes place in a single direction inside the channels.

In certain cases, to offset the smaller increase in pressure due to this helical movement, the curvature of the blade will be increased accordingly.

FIG. 3B shows an example in which two helices are generated inside a same channel. The expression "double helix" describes two helical movements generated within a same flow channel in the opposite direction. According to one embodiment, in the impellers the movement imparted to the fluid is preferably oriented from the housing in the immediate vicinity of the blades $\mathbf{6}_i$, $\mathbf{6}_{i+1}$ towards the center of the channel to profit from the natural tendencies created by the complementary Coriolis acceleration.

The fluid helices thus formed can exhibit variable pitches, the variation in pitch being produced in the axis of flow of the fluid inside the channel. The distance between two homologous points on the helix diminishes progressively for example along the flow channel.

Figure 4:
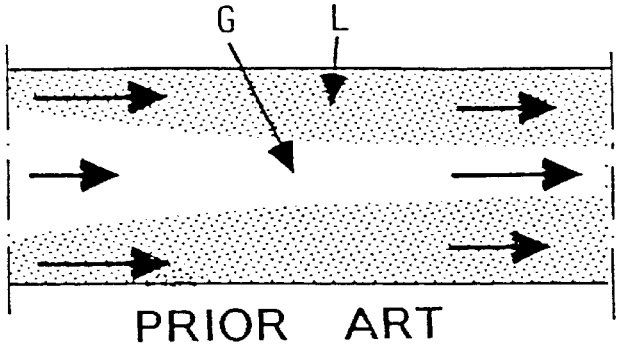

FIG. 4 shows a longitudinal section of an impeller showing the distribution of the gaseous and liquid phases, and the velocities resulting from the effect of the centrifugal forces. The light gaseous phase G is concentrated in the center of the channel and the liquid phases L at the periphery. This figure shows that the concentration of the gaseous phase increases from the walls towards the center of the channels. This phenomenon helps to promote the transfer of energy and momentum through two effects:

- the geometry of the flow makes it possible to increase the interaction surface and hence the transfers of energy and of momentum between the phases when compared to a usual flow exhibiting just one unidirectional transverse concentration gradient;
- the gaseous central portion of the flow tends to contract in the axial direction if the rotation is not too fast, which implies a slowing of the peripheral liquid or liquids and an acceleration of the gas, which corresponds to the effect being sought.

The intensity of the rotation of the flow can be characterised by the dimensionless ratio S usually denoted by the term "swirl number":

$$S = \frac{\int\int u_1(xu_y - yu_x)dxdy}{r_{\max}\int\int u_1^2 dxdy}$$

in which $u_1$ is the longitudinal component of the velocity, $u_x$ and $u_y$ are its transverse components (in the plane of rotation), $r_{max}$ is the greatest value of $r=\sqrt{x^2+y^2}$ over the straight section, the integrals being calculated over a transverse straight section of the channel and the origin of the axes being located at the barycenter of the section.

When a double helix flow is produced, S is calculated over one half of the transverse section of the flow channel.

This dimensionless ratio in fact characterises the ratio of the flux of the kinetic moment to the flux of the longitudinal momentum.

The aim is to work with a value of S which is sufficiently large to increase the length of interaction of the liquid and gaseous phases but not too large in order to avoid the centrifugal forces due to this rotation separating the phases and producing the opposite effect to that being sought. For this, the mechanical devices disposed inside a flow channel, some examples of which are given by way of illustration in FIGS. 5 to 8, will be dimensioned and disposed in the flow channel so as to obtain the desired value of S.

The longitudinal component of the velocity $u_1$ is fixed by the nominal operating conditions of the pump, depending on its speed of rotation and its general geometric characteristics. The calculation of $u_1$, well known in the art, will not be explained.

The transverse component of rotation $u_t=\sqrt{(u_x^2+u_y^2)}$ is usually zero or of small value in pumps exhibiting the characteristics of the prior art. In the devices produced according to the invention, the value of the transverse component adopts a value other than zero imposed by the mechanical devices disposed in the channels.

In order to obtain the best performance and to make the best use of the specific features of the present invention, the geometry and the dimensions of the mechanical devices positioned in the channels are chosen to impose rotation velocities having a rotation component $u_t$ the value of which is such that the ratio S given above lies in a range from 0.3 to 0.8 and preferably between 0.5 and 0.75.

According to the prior art, the helical natural flow described above is characterised by values of S which are very low, well below 0.1.

Assuming that the velocities $u_t$ and $u_1$ are uniform over the transverse section for calculation, the expression for S is simplified to $$S \cong \frac{u_t}{u_l} \cdot \frac{r_{mean}}{r_{\max}} \quad \text{with}$$

$$r_{mean} = \frac{2\pi \int\int r d_x d_x}{(\text{area of section})}$$

the ratio of ut/u1 corresponding to the tangent of the angle of the helix. FIG. 3A shows the angle α of the helix.

Thus, S is proportional to the tangent of the angle of the helix, the value of the proportionality ratio depending on the shape of the section of the channel and the distribution of the flow in the channel.

Generally, the tangent of the angle can be defined by tg α≡k*S with k: proportionality factor which depends notably on the geometry of the blades and the channels and the flow characteristics (nature, flow velocity).

The value of k can be obtained experimentally by velocity measurements or calculated by applying the flow calculation software tools according to the so-called Navier-Stockes theory, known in the art, or any other techniques available in this technical domain.

The value of the angle α to be exhibited by the helix is defined knowing the value of k for the flow channels of a diffuser or an impeller in which it is desired to generate a flow in the form of a helix (single or double) and considering the values of S to be obtained.

Considering a value of k equal to 1.2 for example and seeking to verify a value for S of between 0.3 and 0.8, a helix will be defined having an angle such that the value of its tangent is $0.6 \leqq \text{tg}\alpha \leqq 0.9$, and more generally $0.35 \leqq \text{tg}\alpha \leqq 1.0$.

The described devices can thus be dimensioned by successive approximations, determining each time, experimentally or by calculation, the value of the proportionality factor k obtained in step i, then correcting the dimensions in step i+1 to obtain the angle α or the number S within the desired range.

Figure 5:
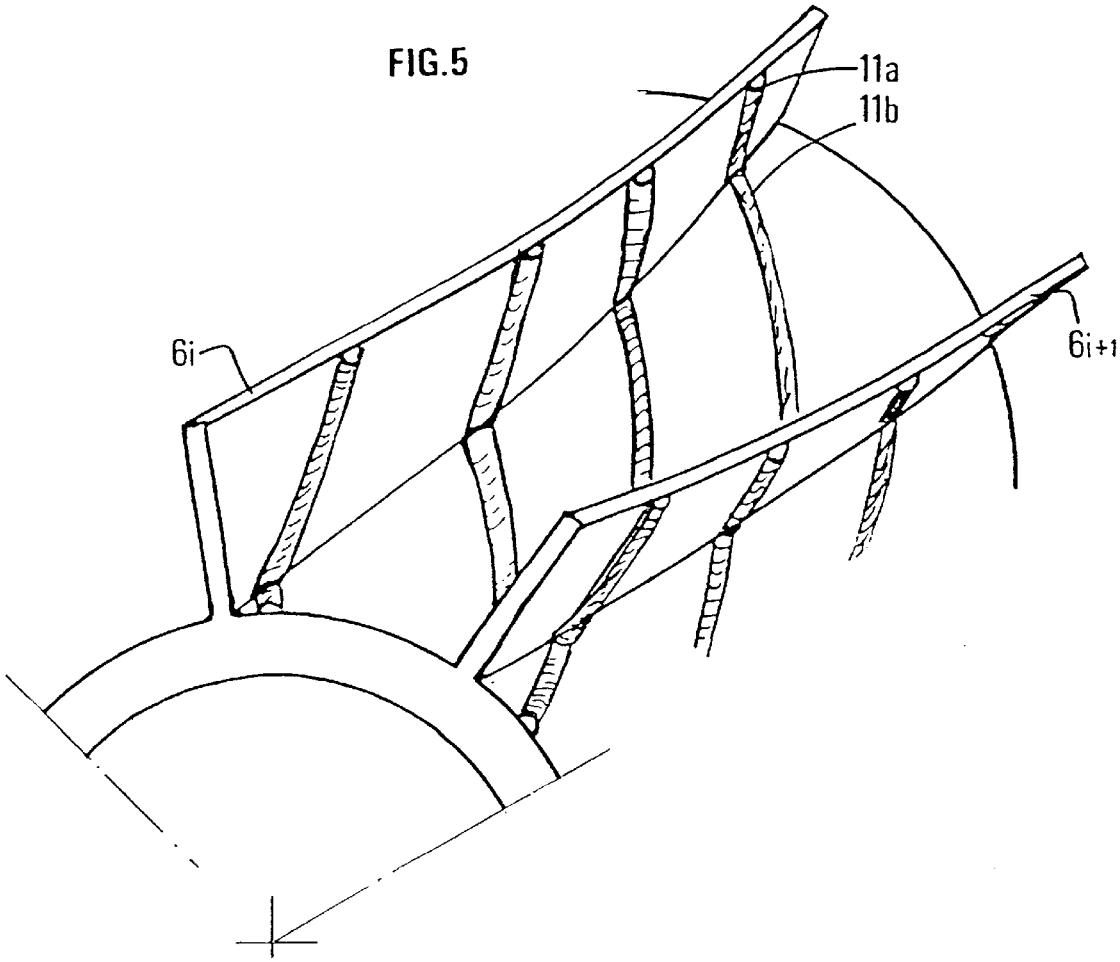

FIG. 5 shows a first embodiment of the device according to the invention in which the device used to create a helix or a fluid movement in the form of a helix are formed by a bead 11 disposed in a helix on the walls of the channels, preferably on the hub and the blades partly delimiting a flow channel.

This bead can be formed in practice by depositing a weld bead on the hub and on the two walls of the blades defining the flow channel for the fluid. The dimensions of the bead and the manner in which it is deposited (pitch between two consecutive portions 11*b* deposited on the hub or on the walls, shape of the bead for the three joined portions 11*a,* and 11*b,* (and beads on the hidden surface of blades 6*i;* and 6*i*+1 not visible in the figure) deposited on the first blade, the hub and the second blade) are such that a movement is generated in the form of a helix having an angle α allowing the desired value of S to be obtained.

The height of the bead for example will be chosen from a range of values between ⅕ and ⅛ of the value of the width of the flow channel in which it is deposited. The width of the channel is defined as the shortest distance between two consecutive blades and measured along an arc of a circle concentric with the axis of rotation of the pump for example.

The length of the flow channel is defined as the length of the median line of the blades also called the camber line.

The value of the pitch between two consecutive portions of the bead deposited on the hub or on the blades can be variable as defined previously.

The bead can be disposed on just one portion of the length of the blades and the hub partly defining the flow channel or over its entirety, considering the direction of flow of the fluid.

Another embodiment illustrated in FIG. 5*a* forms grooves 12*a* and 12*b* (and grooves in the hidden surface of blades 6*i* and 6*i*+1 not shown) in the walls mentioned previously of the blades and the hub.

In exactly the same way, the grooves have dimensions and a disposition defined so as to generate the desired helical flow and respect the angle α.

For grooves, the depth of the grooves may vary between 1/10 and 1/20 of the thickness of the wall in which it is located, taking account of the mechanical characteristics of the assembly. The pitch between two consecutive grooves disposed respectively on the hub or the blades may be chosen to obtain a helix with a variable pitch. The joined portions 12*a,* and 12*b* of the grooves in the blades and the hub for example will be such that they make it possible to obtain a movement in the form of a helix having an angle α allowing the desired value of S to be obtained.

The use of grooves appears to be best adapted for so-called thick blades.

The start of the helix thus formed is preferably disposed in the vicinity of the inlet of the passage.

Figure 6:
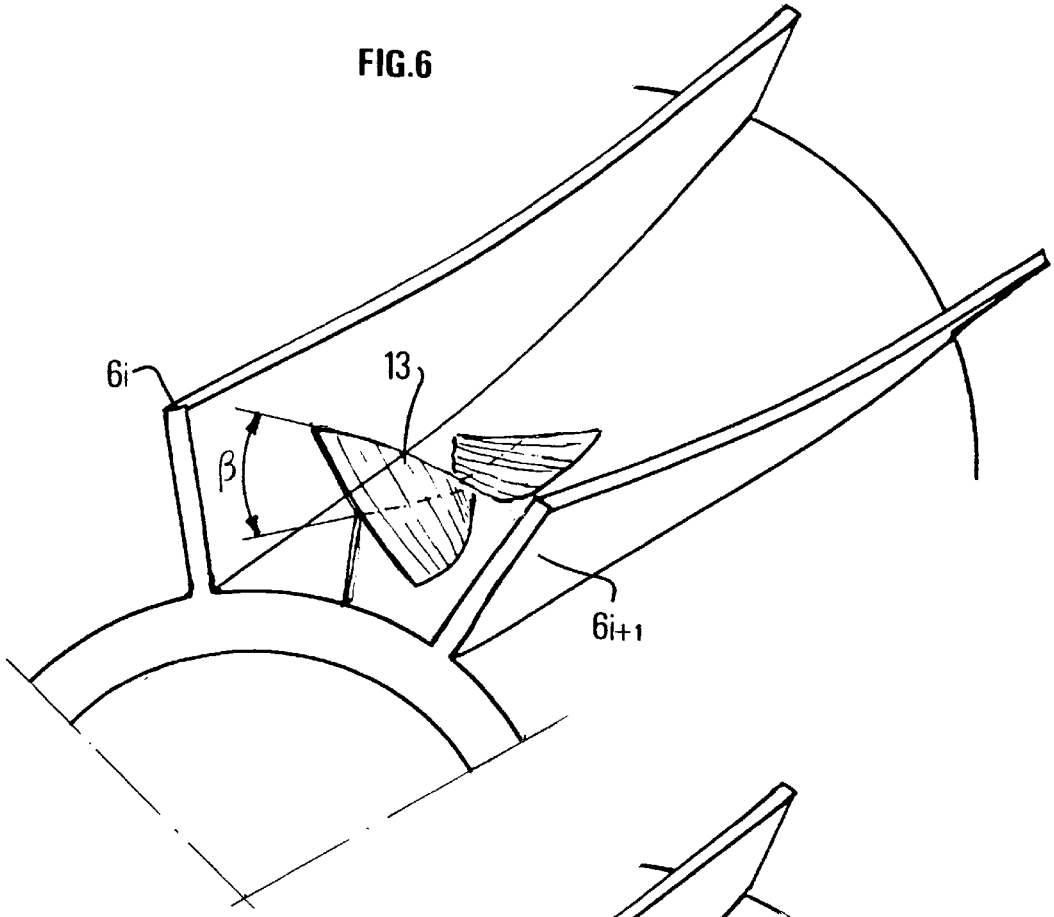

FIG. 6 shows another embodiment in which the devices are formed by one or more helically twisted strips 13 which are disposed inside one or more flow channels.

If β as shown in FIG. 6 denotes the angle of twisting of the strip, the value of β is chosen to be identical to the value of the angle α of FIG. 3A allowing the desired value of S to be obtained.

The length of the strip can be chosen so as to be greater than or equal to the length corresponding to a quarter turn of the helix generated.

When there is only one strip in the channel, it can be placed for example in the vicinity of the inlet considering the direction of flow of the multiphase fluid. The strip has a form and a geometry such that it extends over at least a portion of the length of this channel.

Such helical strips are effective for generating turning flows.

These structure ensure that the fluid is set in rotation in just one direction. This variant will be used preferably in stators or turning portions of the compression device.

Figure 7:
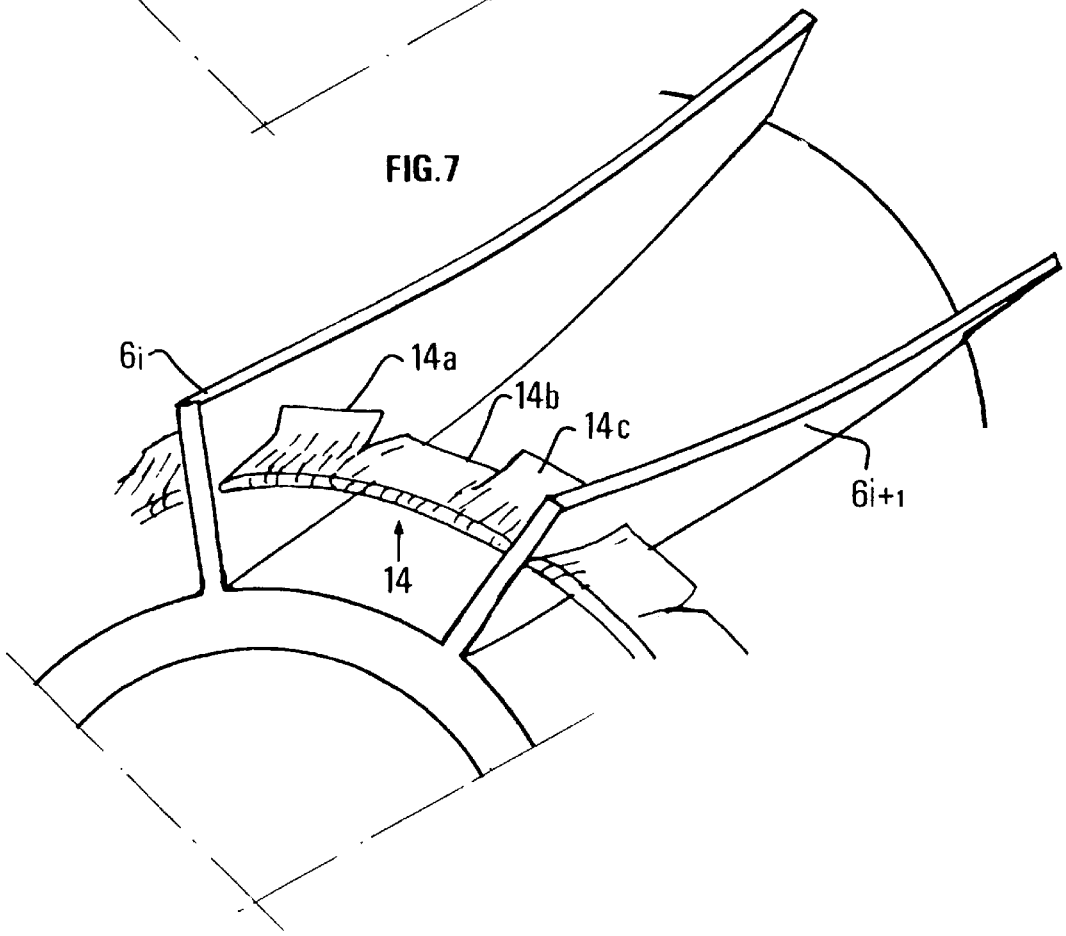

To produce a flow with a double rotation as described in FIG. 3B, it is possible to proceed by disposing a devices such as described in FIG. 7 inside the flow channel.

The flow channel is provided with a circumferential blade 14 of small size, disposed in the inlet section, the transverse section of which is appropriate for deflecting the fluid near the housing in the proximity of the blades and towards the hub in the central portion of the channels. This small size blade is designed like an auxiliary blade.

The blade 14 can comprise at least three portions 14*a*, 14*b*, 14*c*, the portions 14*a* and 14*c* closest to the housing being substantially equal to a quarter of the width 1 between two successive blades $\mathbf{6}_i$, $\mathbf{6}_{i+1}$, and the portion 13*b* to half this width.

The form and the dimensions given to the portions 14*a* and 14*c* are such that the fluid in flow is deflected for example towards the housing whereas the form given to the portion 14*b* makes it possible to deflect the fluid towards the hub.

In this way the two helices are generated in opposite directions inside a same flow channel.

The deflection of the fluid corresponds to the change in direction of the fluid between the direction of flow at the inlet of the flow channel and the direction at the extremity of the previously mentioned portions of the blade.

Figure 8:
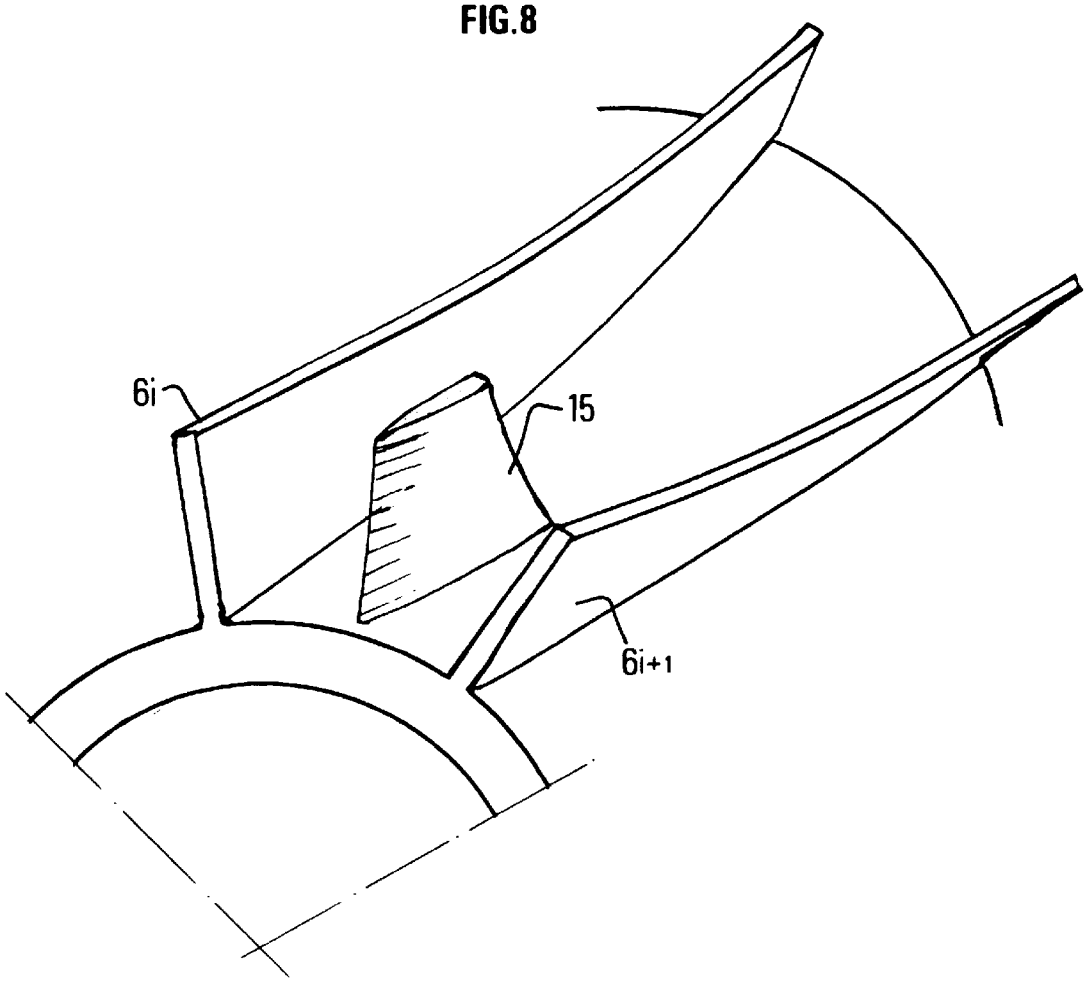

Another embodiment of the device according to the invention is described in FIG. 8.

In this example blades 15 called "intermediate blades" which notably exhibit the particular feature of being shorter than the main blades, are disposed for example in the front third of the length of the flow channel and have a length/height rake ratio of approximately 1 and possibly less than 1.

These blades exhibit a profiled transverse section at their leading edge but not at their trailing edge. Such blades are usually employed in the art to obtain a large turbulent zone.

Without going beyond the scope of the invention, it is possible to dispose any physical structures serving to artificially mix the flow inside one or more flow channels for the fluid. The structures can exhibit a more or less complex form and be disposed in the front portion of the flow channel for example (always considering the direction of flow of the multiphase fluid).

Without going beyond the scope of the invention, all the embodiments given for the impellers can be applied in the rectifiers or stators forming fixed portions of the hydraulic cells.

What is claimed is:

1. A device which varies pressure of a multiphase fluid having at least one liquid phase and at least one gaseous phase, comprising:

a housing, a hub, a rotating shaft, and at least two blades defining at least one flow channel for the multiphase fluid, the at least one flow channel containing at least one turbulence producing structure which generates a turbulent zone therein which mixes the at least one liquid and the at least one gaseous phase of the multiphase fluid.

2. A device according to claim 1, wherein:

the at least turbulence producing structure generates a flow in the at least one single channel having at least one single helix in the at least one flow channel.

3. A device according to claim 2, wherein:

the at least one helix has an angle α such that an intensity of the flow satisfies a dimensionless ratio S $$S = \frac{\int\int u_1(xu_y - yu_x)dxdy}{r_{\max}\int\int u_1^2 dxdy}$$

in which $u_1$ is a longitudinal component of the velocity, $u_x$ and $u_y$ are transverse components thereof in a plane of rotation, $r_{max}$ is a greatest value of $r=\sqrt{x^2+y^2}$ with a value of S is between 0.3 and 0.8.

4. A device in accordance with claim 3 wherein:

the value of S is between 0.5 and 0.75.

5. A device according to claim 2, wherein:

the at least one turbulence producing structure is at least one bead having a helical shape disposed on walls of at least one of the at least two blades and the hub.

6. A device according to claim 5, wherein:

the at least one bead is disposed inside at least one flow channel of at least one impeller.

7. A device according to claim 6 wherein:

a height of the at least one bead is between ⅕ and 1/10 of a width of a flow channel.

8. A device according to claim 6, wherein:

the at least one bead having a helical shape has a variable pitch.

9. A device according to claim 5 wherein:

the at least one bead is disposed inside at least one flow channel of at least one diffuser.

10. A device according to claim 9 wherein:

a height of the at least one bead is between ⅕ and 1/10 of a width of a flow channel.

11. A device according to claim 5 wherein:

a height of the at least one bead is between ⅕ and 1/10 of a width of a flow channel.

12. A device according to claim 11, wherein:

the at least one bead having a helical shape has a variable pitch.

13. A device according to claim 5, wherein:

the at least one bead having a helical shape has a variable pitch.

14. A device according to claim 2, wherein:

the at least one turbulence producing structure is at least one helical groove formed in at least one wall of at least one flow channel extending over at least a portion of a length of the flow channel.

15. A device according to claim 14, wherein:

the at least one helical groove has a depth of between 1/20 and 1/10 of a thickness of one of the at least two blades forming the flow channel.

16. A device according to claim 15, wherein:

the at least one groove is positioned in at least one impeller.

17. A device according to claim 15, wherein:

the at least one groove is produced in at least one rectifier.

18. A device according to claim 15, wherein:

the at least one bead having a helical shape has a variable pitch.

19. A device according to claim 5 wherein:

the at least one bead is disposed inside at least one flow channel of at least one diffuser.

20. A device according to claim 19, wherein:

the at least one groove having a helical shape has a variable pitch.

21. A device according to claim 14, wherein:

the at least one groove is produced in at least one rectifier.

22. A device according to claim 14, wherein:

the at least one groove having a helical shape has a variable pitch.

23. A device according to claim 2, wherein:

the at least one turbulence producing structure comprises at least one of a twisted strip or an auxiliary blade disposed in at least one flow channel.

24. A device in accordance with claim 1 wherein:

the at least one turbulence producing structure generates a pair of helixes in the least one flow channel.

25. A device in accordance with claim 24 wherein:

the pair of helixes rotate in opposite directions.

26. A device according to claim 24, wherein:

the at least one turbulence producing structure is at least one bead having a helical shape disposed on walls of at least one of the at least two blades and the hub.

27. A device according to claim 26 wherein:

the at least one bead is disposed inside at least one flow channel of at least one impeller.

28. A device according to claim 26 wherein:

the at least one bead is disposed inside at least one flow channel of at least one diffuser.

29. A device according to claim 26 wherein:

a height of the at least one bead is between ⅕ and 1/10 of a width of a flow channel.

30. A device according to claim 1, wherein:

the at least one turbulence producing structure comprises at least one of a twisted strip or an auxiliary blade disposed in at least one flow channel.

31. A device according to claim 30, wherein:

the twisted strip is disposed in proximity to an inlet of at least one of the at least one flow channel.

32. A use of a device according to claim 1 comprising:

pumping a multiphase fluid.

33. A method of transferring energy produced in a device which varies pressure of a multiphase fluid having at least one gaseous phase and at least one liquid phase in at least one flow channel with the multiphase fluid passing through the at least one flow channel comprising:

varying the pressure of the multiphase fluid in the at least one flow channel with a structure therein which generates a turbulent zone which mixes the at least one liquid and the at least one gaseous phase.

34. A method according to claim 3, wherein:

the structure produces at least one helical rotation in the multiphase fluid inside the at least one flow channel which mixes the at least one liquid and the at least one gaseous phase.

35. A method according to claim 33, wherein:

flow of the multiphase fluid through the at least one flow channel is at least one helical flow having an angle α such that an intensity of the flow satisfies a dimensionless ratio S $$S = \frac{\int\int u_1(xu_y - yu_x)dxdy}{r_{\max}\int\int u_1^2 dxdy}$$

in which $u_1$ is a longitudinal component of the velocity, $u_x$ and $u_y$ are transverse components thereof in a plane of rotation, $r_{max}$ is a greatest value of $r=\sqrt{x^2+y^2}$ with a value of S is between 0.3 and 0.8.

36. A method according to claim 35, wherein:

S is between 0.6 and 0.75.

37. A method according to claim 36, wherein:

a pitch of the at least one helical flow is varied to reduce a pitch thereof progressively to transform kinetic energy of the at least one liquid phase into rotational energy which reduces a longitudinal flow velocity of the at least one liquid phase longitudinally along the device.

38. A method according to claim 35, wherein:

the helical flow is in an opposite direction to a direction of rotation of the device.

39. A method according to claim 38, wherein:

a pitch of the at least one helical flow is varied to reduce a pitch thereof progressively to transform kinetic energy of the at least one liquid phase into rotational energy which reduces a longitudinal flow velocity of the at least one liquid phase longitudinally along the device.

40. A method according to claim 35, wherein:

a pitch of the at least one helical flow is varied to reduce a pitch thereof progressively to transform kinetic energy of the at least one liquid phase into rotational energy which reduces a longitudinal flow velocity of the at least one liquid phase longitudinally along the device.

41. A method according to claim 35, wherein:

at least two helices are generated inside a same channel, the two helices respectively having opposite directions of rotation, the directions of rotation being from a housing towards a center of the flow channel.

42. A method according to claim 41, wherein:

a pitch of the at least one helical flow is varied to reduce a pitch thereof progressively to transform kinetic energy of the at least one liquid phase into rotational energy which reduces a longitudinal flow velocity of the at least one liquid phase longitudinally along the device.

* * * * *